United States Patent [19]

Phipps et al.

[11] 4,197,481

[45] Apr. 8, 1980

[54] MAGNETICALLY FOCUSSED TUBE

[75] Inventors: Graham H. G. Phipps; Brian L. Dore, both of South Devon; Harold Taylor, Devon, all of England

[73] Assignees: International Standard Electric Corporation, New York, New York

[21] Appl. No.: 906,512

[22] Filed: May 16, 1978

[30] Foreign Application Priority Data

May 19, 1977 [GB] United Kingdom ..... 21108/77

[51] Int. Cl.[2] ..... H01J 1/02; H01J 7/24; H01J 61/52; H01K 1/58

[52] U.S. Cl. ..... 313/30; 313/17; 313/36; 313/23; 313/32; 313/293

[58] Field of Search ..... 313/17, 18, 19, 22, 313/23, 30, 32, 36, 293

[56] References Cited

U.S. PATENT DOCUMENTS

| | | | |
|---|---|---|---|
| 2,513,920 | 7/1950 | DeWalt | 313/19 X |
| 2,615,137 | 10/1952 | Duke | 313/32 X |
| 2,805,361 | 9/1957 | Brown | 313/36 X |
| 2,844,752 | 7/1958 | Hoover | 313/19 X |
| 3,955,114 | 5/1976 | Behenna et al. | 313/36 |

*Primary Examiner*—Saxfield Chatmon, Jr.
*Attorney, Agent, or Firm*—John T. O'Halloran; Peter C. Van Der Sluys

[57] ABSTRACT

Magnetically focussed tube having a gate cooler separate from the anode cooler and of higher power capacity than previous magnetically focussed tubes. Other structural features include simplified anode and cooling jacket and heat barrier at ends of cathode.

4 Claims, 4 Drawing Figures

23
7
8
22
33
32
11
21
20
11
9
34
19
18
15
16
38
10
17
26a
28
24
26
30
1
6
2
12
36
5
4
3
A
A
4a
3a
14
37
31
27
25
13
27a
29
39

MAGNETICALLY FOCUSSED TUBE

This invention relates to magnetically beamed or focussed power valves.

Such valves are described in our British Patent Nos. 1,195,703 and 1,434,984.

U.K. Pat. No. 1,434,984 discloses for the first time a power valve in which the grid or gate electrode is formed as a main structural unit supporting within it a cathode by means of intermediate insulating spacers. It is an object of the present invention to embody that basic concept into a valve of much higher power capability.

According to the present invention there is provided a magnetically-focussed power valve comprising a tubular anode, an elongate cathode structure and a gate electrode structure each extending axially within the anode, electrical insulators arranged to locate the cathode in and relative to the gate electrode structure, the gate electrode structure being in good heat transfer connection with a first cooling device at one end of the valve, the anode being in good heat transfer connection with a second cooling device.

According to another aspect of the present invention there is provided a magnetically-focussed power valve comprising a tubular anode structure, a cooling jacket for cooling the anode structure, an elongate electron-emissive cathode structure within the anode structure and a gate electrode structure extending the length of the cathode structure between the cathode and the anode structure, the gate electrode structure being thermally connected to a fist cooling device at one end of the valve, the cooling device, is more of the valve, removing more than 100 watts of heat energy from the gate electrode structure.

In order that the invention can be clearly understood reference will now be made to the accompanying drawings in which.

Figure 1:
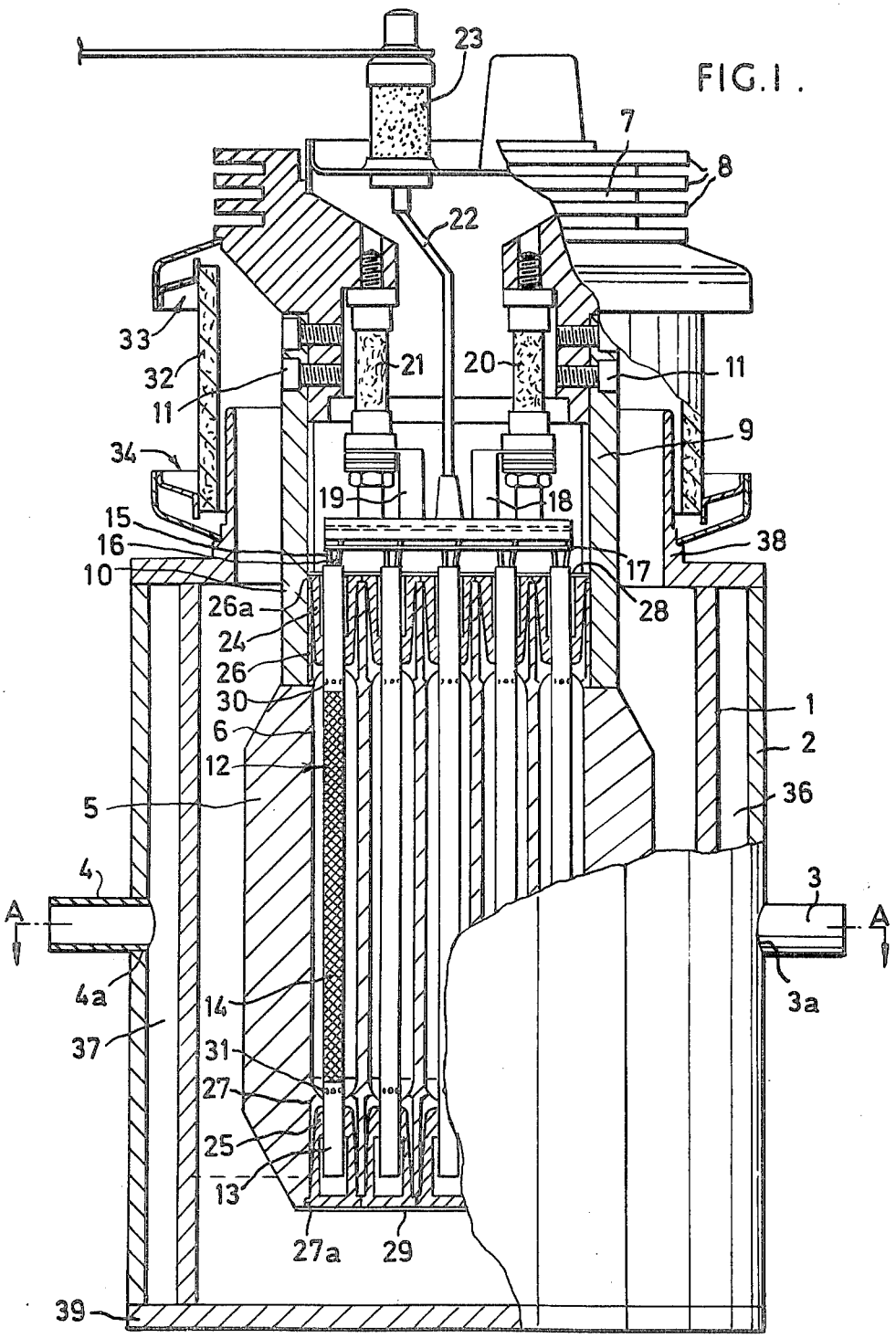
FIG. 1 shows in part cross section a magnetically beamed triode valve in accordance with an embodiment of the present invention.

Referring to the drawings the valve comprises a tubular anode 1 formed of copper. Inlet and outlet pipes 3 and 4 for the coolant, which may be water, are shown connected to the jacket 2.

Extending axially within the anode 1 is a metallic gate electrode structure 5 formed from copper and having 5 axial slots such as 6 whose surfaces normal to the surface of the drawing constitute electrode surfaces. The electrode structure 5 is connected with a cooling device 7 having air cooling fins 8 which, in the embodiment described, are of circular configuration.

The gate structure 5 is supported from the cooling device 7 by means of two heavy metal legs 9 and 10 which are secured at one end to the cooling device 7 by means of screwed and brazed joints such as 11 and, at the other end, by similar joints (not shown). The legs 9 and 10 provide paths of good electrical and thermal conductivity.

Housed within each slot such as 6 is an elongate cathode such as 12 comprising a metal tube 13 having an electron emissive layer 14 thereon and an internal heater element (not shown) whose terminal leads 15 and 16 are connected to respective bus bars 17 (only one is visible in the drawing but a second identical to the first lies immediately behind the one shown). These bus bars are supported by means of bent metal tags 18 and 19 to ceramic support pillars 20 and 21 secured to the cooling device 7.

Rod-like connection leads such as 22 connect each of the bus bars with a respective external connection terminal 23 (another identical terminal is disposed behind the one shown for connection to the other bus bar also not shown).

Each cathode is located within the gate electrode structure by two ceramic insulating bushings such as 24 and 25. These bushings are located in bores 26 and 27 at opposite ends of the gate electrode structure and each bore 26 and 27 has a counter bore 26*a* and 27*a* which receives a flange on the ceramic bushing so as to symmetrically position the cathode in the gate electrode slot 6.

Over the top of the insulating bushings are secured retaining plates 28 and 29 to secure the bushings.

As can be seen each bushing has a slightly tapering outer surface so that the only point of contact of the bushing with the gate electrode structure is by means of the closure plate 28 and 29 and the inner edges of the flanges which locate in the counter bores 26*a* and 27*a*. This ensures that the tracking path from the cathode to the gate is made as long as possible.

The cathode structures 12 are free to move axially in the gate electrode structure and are supported merely by the heater and heater cathode terminal leads 15 and 16 from the bus bars 17. Thus the cathodes can contract and expand axially without restriction.

As can be seen each cathode has a thermal barrier between each end of the emissive coating 14 and the pertaining insulating bushing. In the preferred embodiment this barrier is formed by a ring of holes 30 and 31. These holes take away approximately half the metal of the tube 13 at those positions. It would be possible to find other ways of preventing heat flowing from the emissive portion of the cathode outwardly but the holes shown are preferred because they effectively minimise the heat flow whilst at the same time maintain the rigidity and strength of the tube at that position.

The gate electrode structure and the cathode structure together with the cooling device form a complete unit which is secured to the anode 1 by means of the cylindrical ceramic 32 and the ceramic-metal seals 33 and 34.

Figure 2:
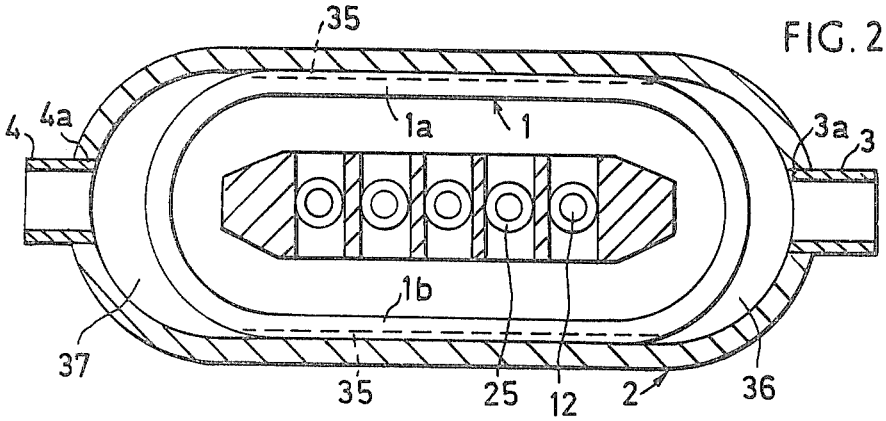
FIG. 2 shows a section on the line A—A of FIG. 1 in the direction of the arrows and FIGS. 3 and 4 show schematically details of the construction of the anode and cooling jacket.
Figure 3:
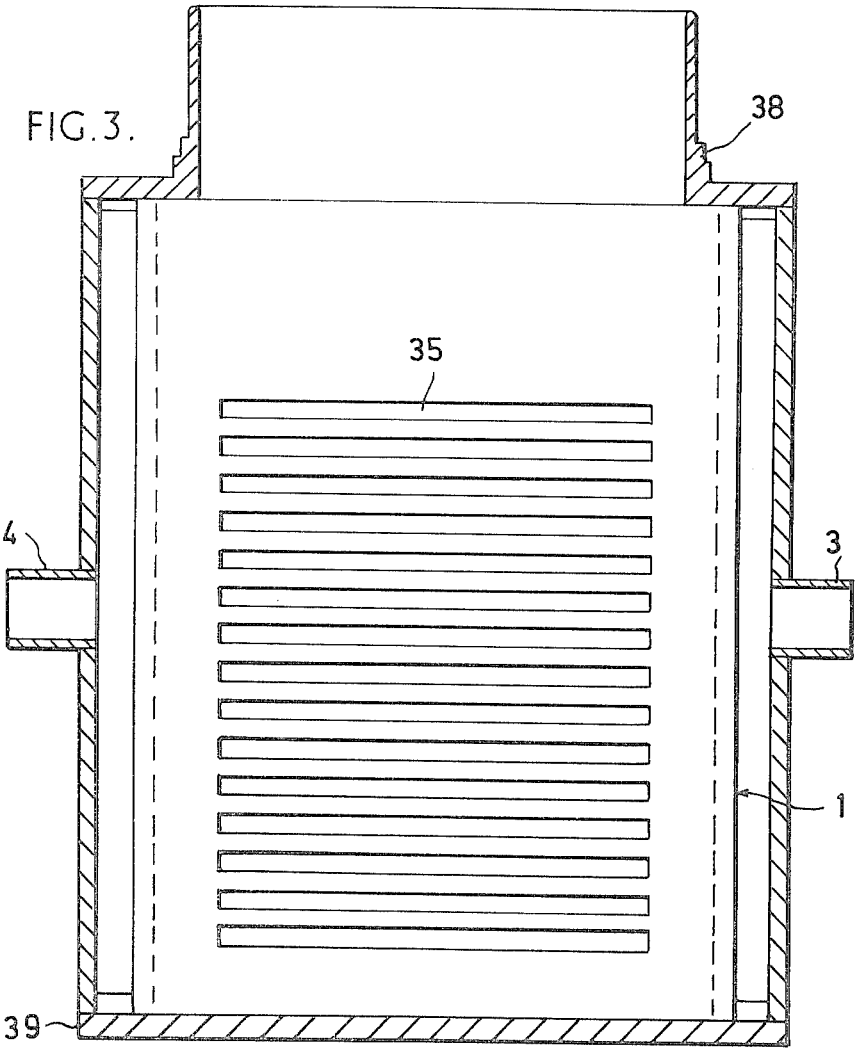
Figure 4:
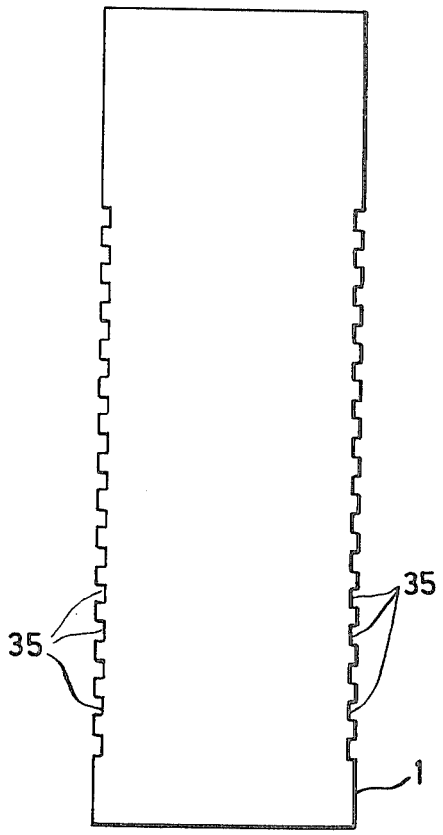

Referring now to FIG. 2 there is shown details of the manufacture of the anode and cooling jackets. The anode 1 is formed initially from a copper cylinder which is squashed to produce the flat sides 1*a* and 1*b*. This tube is then subjected to a milling operation to mill transverse grooves such as 35 in the outer surfaces. In the embodiment shown there are 15 grooves in all approximately 0.050 inches deep and 0.125 inches wide. The outer jacket 2 is similarly formed by squashing a circular tube of intially larger diameter than the anode to the same general configuration. The two tubes have the same length and are placed one inside the other so that crescent-shaped coolant chambers 36 and 37 are formed and communicate with each other via the grooves 35 which being closed by the cooling jacket 2, constitute cooling channels connected to cooling chambers 36 and 37. The anode and cooling jacket assembly is completed by brazing on the top and bottom parts 38 and 39.

This method of construction results in a relatively simple inexpensive anode-cooling jacket assembly. The inlet and outlet flow pipes 3 and 4 are secured in holes 3*a* and 4*a* in the cooling jacket in any convenient manner.

In tests we have conducted we have found that the gate electrode structure generates more than 100 watts of heat energy and, in the embodiment described, is in excess of 300 watts. By arranging for the cooling structure 8 to dissipate in the region of 300 watts we can maintain the gate electrode at around 300° C. and the cooling structure 8 together with the associated metal-ceramic seals at 33 can be held at about 150° C.

In the embodiment described the rigid metal legs 9 and 10 which connect the gate electrode with the cooling device 8, have a total cross-sectional area of about $\frac{3}{8}$th sq. in.

We claim:

1. A magnetically-focussed power valve comprising a tubular anode, an elongate electron emissive cathode structure and a gate electrode structure each extending axially within the anode, electrical insulators arranged to locate the cathode in and relative to the gate electrode structure, the gate electrode structure being in good heat transfer connection with a first cooling device at one end of the valve, the anode being in good heat transfer connection with a second cooling device, an electric heater within the cathode, means for restricting heat flow from the electron emissive portion of the cathode towards each end of the cathode, each said end having a plurality of holes forming at least part of the heat flow restricting means and maintaining the rigidity and strength of the cathode.

2. The valve of claim 1, wherein the anode has flat sides forming the effective anode surfaces of the valve and the gate electrode structure comprises an integral metallic flat-sided slab with a plurality of through-slots located side by side in and extending parallel to the tubular anode, there being a plurality of cathode structures located within respective ones of the slots.

3. The valve of claim 1, wherein more than 100 watts of heat energy are removed from the gate electrode structure.

4. The valve of claim 1, wherein the cathode is supported in part by the heater permitting axial cathode contraction and expansion.

* * * * *